United States Patent [19]

Taguchi

[11] Patent Number: 5,048,088

[45] Date of Patent: Sep. 10, 1991

[54] LINEAR PREDICTIVE SPEECH ANALYSIS-SYNTHESIS APPARATUS

[75] Inventor: Tetsu Taguchi, Tokyo, Japan

[73] Assignee: NEC Corporation, Tokyo, Japan

[21] Appl. No.: 329,725

[22] Filed: Mar. 28, 1989

[30] Foreign Application Priority Data

Mar. 28, 1988 [JP] Japan ..... 63-75024

[51] Int. Cl.[5] ..... G10L 7/02; G10L 7/00

[52] U.S. Cl. ..... 381/38; 381/36

[58] Field of Search ..... 381/29-32, 381/36-41; 364/513.5, 724.17, 724.01, 724.16

[56] References Cited

U.S. PATENT DOCUMENTS 3,624,302 11/1971 Atal ..... 381/41
4,220,819 9/1980 Atal ..... 381/38
4,301,329 11/1981 Taguchi ..... 381/37
4,852,169 7/1989 Veeneman et al. ..... 381/38
4,932,061 6/1990 Kroon et al. ..... 381/30

*Primary Examiner*—Dale M. Shaw
*Assistant Examiner*—Michelle Doerrler
*Attorney, Agent, or Firm*—Sughrue, Mion, Zinn Macpeak & Seas

[57] ABSTRACT

A linear predictive speech synthesis apparatus which receives a pitch parameter and linear predictive coefficients. The synthesis apparatus includes a device for producing an exciting source signal in response to the pitch parameter, and a device for filtering the exciting source signal in response to the linear predictive coefficients to produce a synthesized speech signal. A cascade frequency characteristic between spectral envelope frequency characteristics of the producing device and the filtering device is designated such as to correspond to a spectral envelope characteristic of an input speech signal.

8 Claims, 3 Drawing Sheets

LINEAR PREDICTIVE SPEECH ANALYSIS-SYNTHESIS APPARATUS

BACKGROUND OF INVENTION

The present invention relates to a linear predictive speech analysis-synthesis apparatus and, more particularly, to an improvement of a synthesis side thereof.

In a conventional linear predictive speech analysis-synthesis apparatus, an impulse train having repetition frequency of a fundamental frequency of an input speech signal is used generally as an exciting source signal on the synthesis side in case the input speech signal is of a voice sound. An example of this type is disclosed in U.S. Pat. No. 4,301,329 bearing the title of "SPEECH ANALYSIS AND SYNTHESIS APPARATUS", assigned to this applicant.

In another conventional speech analysis-synthesis apparatus, a pulse train having a shape corresponding to an envelope waveform which is repeated at a fundamental frequency is also used instead of the impulse train.

The above-mentioned conventional linear predictive speech analysis-synthesis apparatuses have the following shortcoming. In the former apparatus which utilizes the impulse train as the exciting source signal, energy concentrates on a pitch excitation point on the time axis and, thus, a synthesized output speech signal becomes unnatural. In the latter which utilizes a shaped pulse train, the exciting source signal becomes colored while the concentration of energy is avoided. Thus, a synthesized output speech signal becomes different from an input speech signal in a spectral structure, which results in unnaturalness.

SUMMARY OF THE INVENTION

An object of the present invention is, therefore, to furnish a linear predictive speech analysis-synthesis apparatus which is capable of synthesizing a speech signal having excellent sound quality while avoiding concentration of energy and securing the accordance of the spectral structure between an input speech signal and a synthesized output speech signal.

According to the present invention, there is provided a linear predictive speech analysis-synthesis apparatus which comprises, on a synthesis side, an exciting source signal generator for generating an exciting source signal in response to linear predictive coefficients and a pitch parameter, and a speech synthesizing filter for filtering the exciting source signal by a function defined by the linear predictive coefficients and a damping factor, wherein a cascade frequency characteristic of the spectral envelope frequency characteristic of the exciting source signal generator and the spectral envelope frequency characteristic of the speech synthesizing filter is designated to correspond to a spectral envelope characteristic of an input speech signal.

DESCRIPTION OF THE PREFERRED EMBODIMENT

Figure 1:
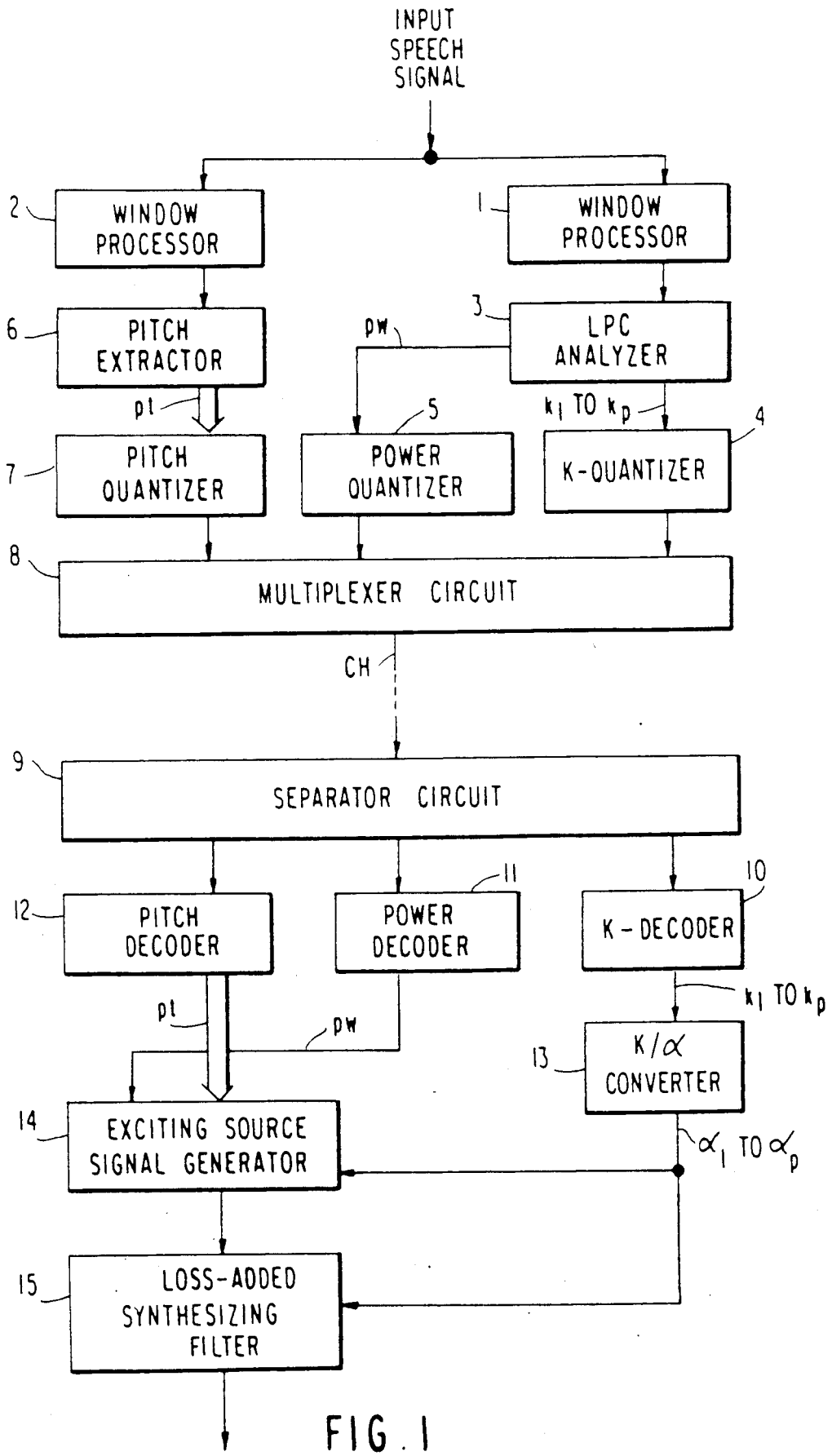
FIG. 1 is a block diagram of an embodiment according to the present invention.

In FIG. 1 showing block diagram of one embodiment of the present invention, an analysis side of a linear predictive analysis-synthesis apparatus which comprises window processors 1 and 2 receiving an input speech signal, a LPC analyzer 3 receiving an output signal of the window processor 1 and outputting K parameters $k_1$ to $k_p$ and a power parameter pw, a K quantizer 4 receiving the K parameters $k_1$ to $k_p$, a power quantizer 5 receiving the power parameter pw, a pitch extractor 6 receiving an output signal of the window processor 2 and outputting a pitch parameter pt, a pitch quantizer 7 receiving the pitch parameter pt, and a multiplexer circuit 8 receiving output signals of the K quantizer 4, the power quantizer 5 and the pitch quantizer 7.

Further, a synthesis side of FIG. 1 comprises a separator circuit 9 receiving an output signal of the multiplexer circuit 8 through a transmission channel CH, a K decoder 10, a power decoder 11, a pitch decoder 12, a $K/\alpha$ converter 13 receiving the K parameters $k_1$ to $k_p$ from the K decoder 10 and outputting parameters $\alpha_1$ to $\alpha_p$, a exciting source signal generator 14 receiving the power parameter pw from the power decoder 11, the pitch parameter pt from the pitch decoder 12 and the parameters $\alpha_1$ to $\alpha_p$ from the $K/\alpha$ converter 13, and a loss-added synthesizing filter 15 receiving an exciting output signal from the exciting source signal generator 14 and the $\alpha$ parameters $\alpha_1$ to $\alpha_p$ from the $K/\alpha$ converter 13 and outputting an output speech signal.

The feature of the present invention resides in the exciting source generator 14 which operates on the basis of the $\alpha$ parameters $\alpha_1$ to $\alpha_p$ and in the loss-added synthesizing filter 15. In FIG. 1, the remaining blocks except for the exciting source signal generator 14 and the loss-added synthesizing filter 15 are the same as those of the first conventional apparatus. Therefore, the exciting source signal generator 14 and the loss-added synthesizing filter 15 will be described, hereinafter, in detail.

Figure 2:
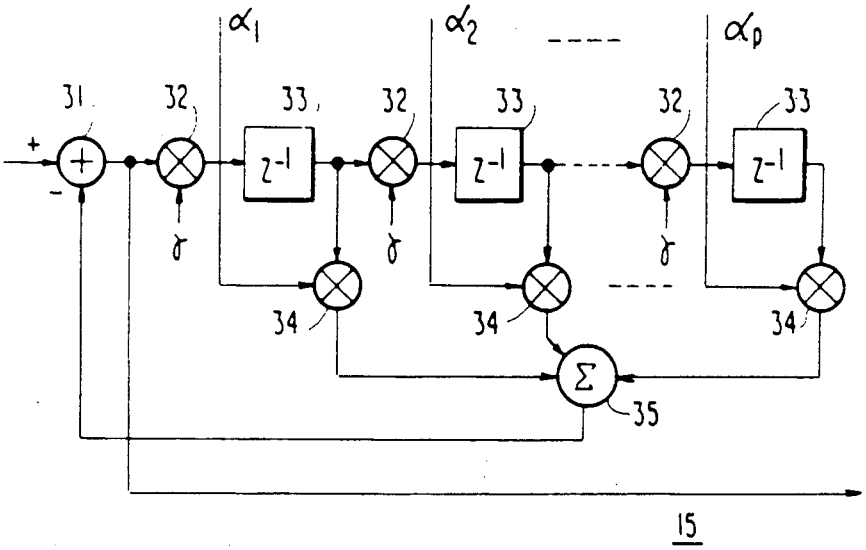
FIG. 2 is a block diagram of a loss-added synthesizing filter contained in FIG. 1.

First, a description will be made of the loss-added synthesizing filter 15. FIG. 2 is a block diagram of the loss-added synthesizing filter 15.

The loss-added synthesizing filter 15 comprises a subtracter 31, p multipliers 32 which receive a constant (damping factor) $\gamma$ of $0<\gamma<1$ as an input from one input end respectively, p delay circuits 33 which give a delay equal to the sampling period in the window processors 1 and 2, p multipliers 34 which receive the $\alpha$ parameter $\alpha_i$ ($i=1, \ldots, p$) and the respective outputs of the delay circuits 33 as an input, and an adder 35. In FIG. 2, the combination of the multiplier 32 and the delay circuit 33 is serially connected as p sets. The output of the i-th delay circuit 33 is also supplied to the other input of the multiplier 34 to which the parameter $\alpha_i$ is inputted. The adder 35 adds up multiplication outputs of all the multipliers 34. The subtracter 31 subtracts the addition output of the adder 35 from an inputted exciting source signal. The subtraction output of the subtracter 31 is also delivered as an output synthesized speech signal. In the loss-added synthesizing filter 15, when the constant $\gamma$ is set to be 1, in other words, when all multipliers 32 are removed, this synthesizing filter 15 becomes the same as a well known conventional LPC synthesizing filter.

Figure 4:
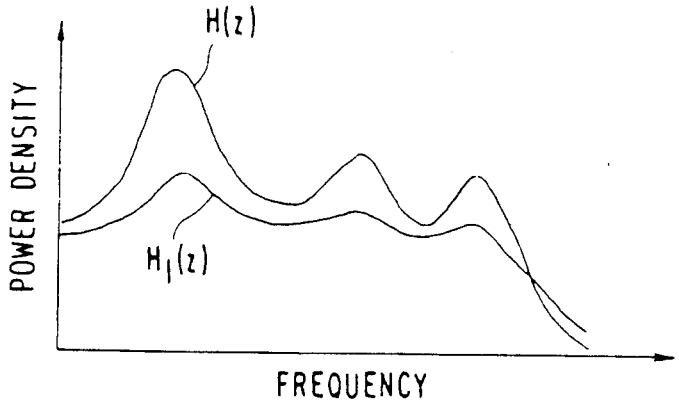
FIG. 4 is a waveform diagram showing a spectral envelope characteristic of the loss-added synthesizing filter according to the present invention in comparison with that of a conventional synthesizing filter.
Figure 5:
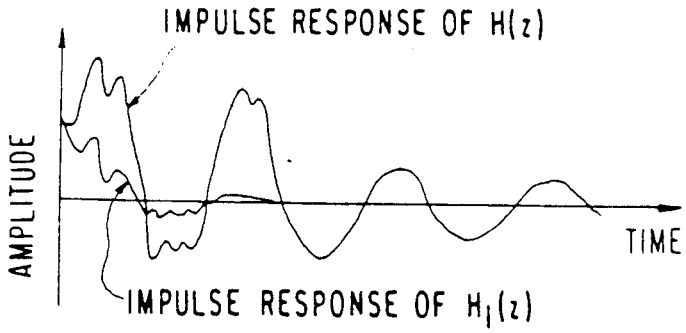
FIG. 5 is a waveform diagram showing an impulse response characteristic of the present loss-added synthesizing filter in comparison with that of the conventional synthesizing filter.

The loss-added synthesizing filter 15 has a construction wherein the loss set by the constant $\gamma$ is given to each stage of the LPC synthesizing filter, and the waveform response thereof is one obtained by damping a waveform response of the conventional LPC synthesizing filter as shown in FIG. 4 and FIG. 5.

The transfer function $H_1(Z)$ of the loss-added synthesizing filter 15 is expressed by $$H_1(Z) = \frac{1}{1 - \sum_{i=1}^{p} \alpha_i \gamma^i Z^{-i}} \quad (1)$$

The transfer function H(Z) of the conventional LPC synthesizing filter employed for a conventional linear predictive speech analysis-synthesis apparatus is expressed generally by $$H(Z) = \frac{1}{1 - \sum_{i=1}^{p} \alpha_i Z^{-i}} \quad (2)$$

Examples of frequency transmission characteristics (spectral envelope characteristics) of H(Z) and $H_1(Z)$ are shown in FIG. 4, and examples of impulse responses thereof are shown in FIG. 5. $H_1(Z)$ in FIGS. 4 and 5 is one obtained when $\gamma=0.8$. When this coefficient $\gamma$ is set at 1.0, $H_1(Z)$ is equal to H(Z). When $\gamma$=Zero, the frequency transmission characteristic of $H_1(Z)$ is leveled completely, and the impulse response is turned to be a unit pulse.

A loss-added synthesizing filter having the same transfer function as the loss-added synthesizing filter 15 can be constructed as well when all the multipliers 32 are removed while a value $\alpha_i\gamma^i$ is inputted, instead of the $\alpha$ parameter $\alpha_i$, to the multiplier 34.

Next, a description will be made on the exciting source signal generator 14.

Figure 3:
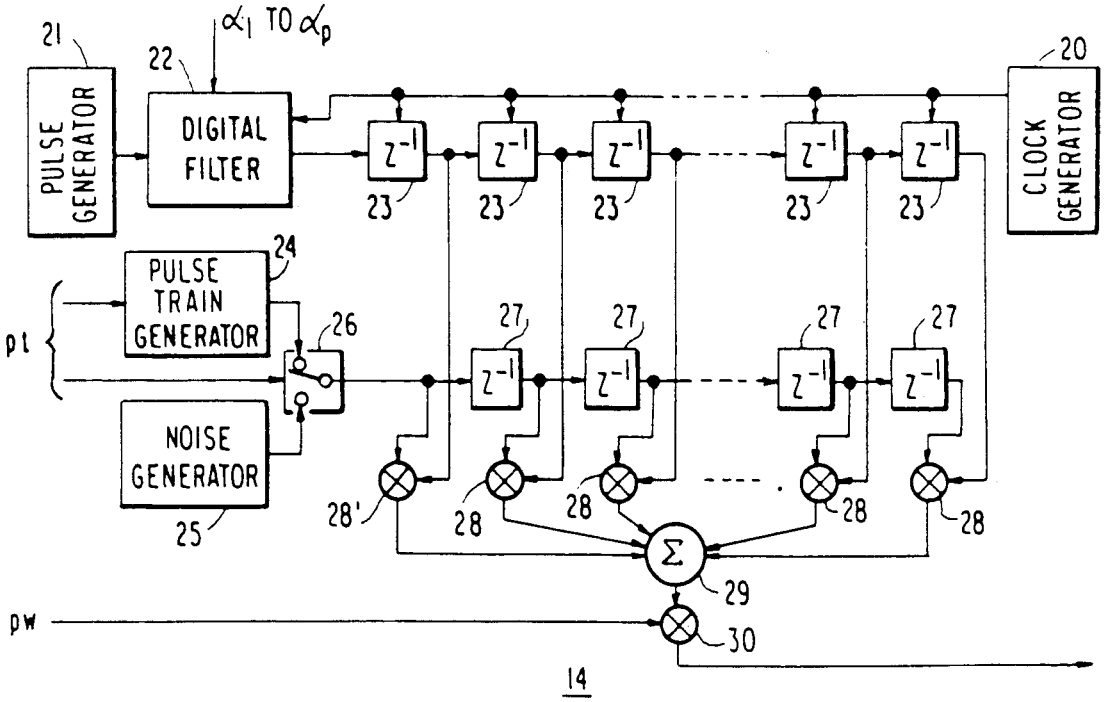
FIG. 3 is a block diagram of an exciting source signal generator contained in FIG. 1.

FIG. 3 is a block diagram of the exciting source signal generator 14, which comprises a clock generator 20, a pulse generator 21, a standard type digital filter 22 which receives output signals of the clock generator 20, and the pulse generator 21, and the $\alpha$ parameters $\alpha_1$ to $\alpha_p$ as inputs, a plurality of delay circuits 23 (the number thereof will be mentioned later) which are connected in cascade to the output of the digital filter 22 and which receive the clock of the clock generator 20, a pulse train generator 24 which receives the pitch parameter pt, a noise generator 25, a switching unit 26 which selects the output of either the pulse train generator 24 or the noise generator 25 under the control of the pitch parameter pt, a plurality of delay circuits 27 which give a delay equal to the sampling period in the window processors 1 and 2, respectively, and which are connected in cascade to the output of the switching unit 26 and numbering less than the delay circuits 23 by one, a plurality of multipliers 28 which receive the set of outputs of the delay circuits 23 and 27 arranged in the same sequence with each other from the last ones, a multiplier 28', which receives the output of the delay circuit 23 disposed at the first stage and the input to the delay circuit 27 disposed at the first stage, an adder 29 which adds up the multiplication outputs of all of the multipliers 28 and 28', and a multiplier 30 which multiplies the power parameter pw by the addition output of the adder 29 and delivers the multiplication output as an exciting source signal. According to a conventional exciting source signal generator, the output of the switching unit 26 is delivered as an output exciting source signal after multiplication by the power parameter pw.

The pulse train generator 24 generates a impulse train at a repetition frequency corresponding to a pitch period in the pitch parameter pt. The noise generator 25 outputs white noise of M sequences or the like. The switching unit 26 selects the output impulse train from the pulse generator 24 in the case of a voiced sound or selects the noise from the noise generator 25 in the case of an unvoiced sound, corresponding to the result of determination of the pitch parameter pt, and delivers the selected output as an exciting pulse.

In FIG. 3, components other than the pulse train generator 24, the noise generator 25 and the switching unit 26 are excited by the exciting pulse from the switching unit 26 and the exciting source signal to be outputted is produced in the following.

In relation to the transfer function H(z) (set by the $\alpha$ parameters $\alpha_1$ to $\alpha_p$) of the LPC synthesizing filter and the transfer function $H_1(z)$ (set by the parameters $\alpha_1$ to $\alpha_p$) of the loss-added synthesizing 15, which are described previously, the standard type digital filter 22 is so constructed that its transfer function is $$H_2(z) = \frac{H(z)}{H_1(z)} = \frac{1 - \sum_{i=1}^{p} \alpha_i \gamma^i z^{-i}}{1 - \sum_{i=1}^{p} \alpha_i z^{-i}} \quad (3)$$

The clock generator 20 outputs the clock in a number corresponding to a required impulse response length of the standard type digital filter 22 for every analysis frame. The repetition frequency of the clock is set to be shorter enough than the sampling frequency in the window processors 1 and 2. The pulse generator 21 outputs one impulse for each analysis frame. Each delay circuit 23 is constructed by D-type flip-flops each using the clock outputted from the clock generator 20 as an operating pulse. Particularly, the flip-flops are combined in parallel for the required number of bits. The number of delay circuits 23 is made to be equal to the number of generated clock pulses of the clock generator 20 during the analysis frame.

In each analysis frame, the $\alpha$ parameters $\alpha_1$ to $\alpha_p$ are inputted so that the transfer function $H_2(z)$ of the digital filter 22 is set. Subsequently, the impulse is inputted from the pulse generator 21, and the digital filter 22 is made to operate by the clock from the clock generator 20. When a plurality of clocks are outputted for the entire frame, a signal representing the impulse response of the standard type digital filter 22 is obtained in the output of each delay circuit 23, and it is held until a subsequent analysis frame comes.

In FIG. 3, a combination of the delay circuits 27, the multipliers 28 and the adder 29 composes a transversal filter having an impulse response which corresponds to the inversion of the impulse response of the digital filter 22 on a time basis. Namely, in this configuration, each tap coefficient is obtained from each delay circuit 23 and each circuit 23 and each multiplier 28 are connected as shown in the drawing. The exciting pulse from the switching unit 26 is applied to this transversal filter, and the output of this filter is made to correspond to the power of the input speech signal by the multiplier 30. Thus, the result is delivered as the exciting source signal to the loss-added synthesizing filter 15. In this case, it is possible that the multiplier 30 is inserted just behind the switching unit 26 instead of just behind the adder 29.

The spectral structure of the exciting source signal from the exciting source signal generator 14 is equal to the spectral structure of the output obtained by that of the digital filter having the transfer function $H_2(z)$ is excited by the exciting pulse from the switching unit 26. Since this exciting source signal is outputted through the loss-added synthesizing filter 15 having the transfer function $H_1(z)$, the spectral structure of the synthesized output speech signal accords with a spectral structure which is obtained by exciting the LPC synthesizing filter having the transfer function $H(z)$ $(=H_1(z)\times H_2(z))$ by the exciting pulse and, consequently, the synthesized output speech signal accords with the spectral structure of the input speech signal.

In addition, according to the present invention, since the impulse response of the transversal filter, which produces the exciting source signal from the exciting pulse, is formed as the time-inversed impulse response as compared with that of the digital filter having the transfer function $H_2(z)$, phase relationship in the process, wherein the synthesized output speech signal is formed from the exciting pulse, is made to be different from phase relationship in processing of the LPC synthesizing filter having the transfer function $H(z)$. Thus the energy in the synthesized output speech signal does not concentrate on a pitch excitation point even when the impulse train is applied as the exciting pulse.

With regard to the constant $\gamma$ applied to the loss-added synthesizing filter 15 and the digital filter 22 in the exciting source signal generator 14, its value is determined through computer simulation or through experimentation. In practice, one preferable value is about 0.8 to derive a good result.

Figure 6:
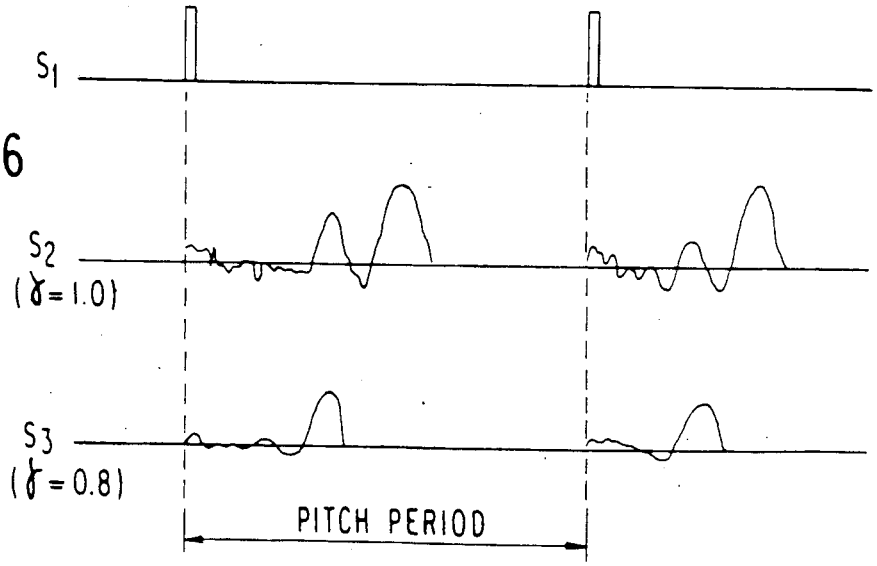
FIG. 6 is a waveform diagram showing an output exciting source signal produced by the present invention in comparison with a conventional exciting source signal.

FIG. 6 shows waveforms of the exciting source signal according to the present invention as compared with a conventional exciting source signal. In this figure, $S_1$ indicates the conventional exciting source signal, i.e., the impulse train. $S_2$ indicates the exciting source signal in case of $\gamma=1$ and $S_3$ indicates the exciting source signal in case of $\gamma=0.8$. When $\gamma=1$, the loss-added synthesizing filter 15 becomes equal to the conventional LPC synthesizing filter as described above. However, in the exciting source signal generator 14, a certain effect can be obtained even when $\gamma=1$.

As described above, according to the present invention, by providing the loss-added synthesizing filter having the function $H_1(z)$ and the exciting source signal generator which forms the exciting source signal from the exciting pulse by using the filter having the function $$H_2(z) = \frac{H(z)}{H_1(z)}$$

and the transversal filter having the time-inverted impulse response, the linear predictive speech analysis-synthesis apparatus, which is capable of producing the synthesized output speech signal wherein no energy concentrates on a pitch excitation point and the accordance is established in the spectral structure between the input speech signal and the output speech signal, thus resulting in excellent sound quality.

What is claimed is:

1. A linear predictive speech analysis-synthesis apparatus having an analysis part receiving an input speech signal and a synthesis part producing a synthesized speech signal, said analysis part comprising:

means for receiving said input speech signal;

means responsive to said input speech signal for extracting first parameters corresponding to linear predictive coefficients;

means responsive to said input speech signal for extracting a second parameter corresponding to pitch information;

means responsive to said input speech signal for extracting a third parameter corresponding to power information; and means for transmitting said first parameters, second parameter and third parameter, said synthesis part comprising:

means for receiving said first parameters, second parameter and third parameter from said analysis part;

means responsive to said first parameters, second parameter and third parameter for generating an exciting source signal, said exciting source signal generating means having a first transfer function, said first transfer function being used to generate said exciting source signal; and means responsive to said first parameters for synthesizing said synthesized speech signal by filtering said exciting source signal by a second transfer function, said second transfer function being defined by said first parameters and by a damping factor, wherein the product of said first and second transfer functions corresponds to a spectral envelope characteristic of said input speech signal.

2. A linear predictive speech analysis-synthesis apparatus as claimed in claim 1, wherein said exciting source signal generating means includes:

an impulse generator for generating an impulse for each analysis frame period;

filter means responsive to said first parameters for filtering said impulse from said impulse generator, said filter means having a function corresponding to said first transfer function;

first delay array means for sequentially delaying the output of said filter means to deliver a plurality of first delay outputs each having different delay times;

exciting pulse generating means responsive to said second parameter for generating an exciting pulse;

transversal filter means for filtering said exciting pulse from said exciting pulse generating means to produce said exciting source signal, said transversal filter means receiving said plurality of first delay outputs as a plurality of coefficients; and means for controlling the level of said exciting source signal delivered from said transversal filter means in response to said third parameter.

3. A linear predictive speech analysis-synthesis apparatus as claimed in claim 1, wherein said first transfer function is defined by $$\frac{1 - \sum_{i=1}^{p} \alpha_i \gamma^i Z^{-i}}{1 - \sum_{i=1}^{p} \alpha_i Z^{-i}}$$

where:

p corresponds to order of linear predictive coefficients, z corresponds to $e^{-j\omega}$, $\alpha_i$ corresponds to said first parameters and, r corresponds to said damping factor, said second transfer function is defined by $$\frac{1}{1 - \sum_{i=1}^{p} \alpha_i \gamma^i Z^{-i}}.$$

4. A linear predictive speech synthesis apparatus comprising:

means for receiving a pitch parameter and linear predictive coefficients;

means for producing an exciting source signal in response to said pitch parameter said producing means including a pulse train generator for generating a pulse train having a pitch associated with said pitch parameter, a noise generator for generating a noise signal, a switching means for alternatively selecting said pulse train or said noise signal, and transversal filter means for filtering an output of said switching means to deliver a filtered signal as said exciting source signal, said producing means having a first spectral envelope frequency characteristic; and means for filtering said exciting source signal in response to a second spectral envelope frequency characteristic, said second spectral envelope frequency characteristic being defined by said linear predictive coefficients and a damping factor, wherein a cascade frequency characteristics between said first and second spectral envelope frequency characteristics is designated to correspond to a spectral envelope characteristic of an input speech signal.

5. The linear predictive speech synthesis apparatus as claimed in claim 4, wherein said exciting source signal producing means includes transversal filter means for filtering the output of said switching means, said transversal filter means receiving a plurality of delay outputs as a plurality of coefficients.

6. The linear predictive speech synthesis apparatus as claimed in claim 5, wherein said transversal filter means comprises a first multiplier connected to receive the output of said switching means, a plurality of second multipliers, a plurality of delay circuits connected in series, a first one of said delay circuits connected to receive the output of said switching means, and adding means connected to receive the outputs of said first multiplier and said second multipliers.

7. The linear predictive speech synthesis apparatus as claimed in claim 5, wherein said filtering means comprises a plurality of first multipliers, each of said first multipliers connected to receive said damping factor a constant damping factor input signal, a plurality of delay circuits respectively connected to receive the outputs of said first multipliers, a plurality of second multipliers respectively connected to receive the outputs of said delay circuits, each of said second multipliers also being connected to receive a different one of the linear predictive coefficients, and adding means connected to receive the outputs of said second multipliers.

8. In a linear predictive speech analysis-synthesis apparatus having an analysis part and a synthesis part wherein exciting source information containing distinguished information on a voiced or unvoiced sound of an input speech signal, information on a fundamental frequency on an occasion when said input speech signal is of the voiced sound and also information on power, and linear predictive coefficients showing a spectral envelope or corresponding coefficient equivalent to said linear predictive coefficients, are measured at a predetermined time interval on the analysis part, while an output speech signal is synthesized on the synthesis part on the basis of the said exciting source information and the said linear predictive coefficients or said corresponding coefficients equivalent to said linear predictive coefficients, the said synthesis part comprising, a loss-added synthesizing filter constructed by adding a predetermined loss to a synthesizing filter set by said linear predictive coefficients or said corresponding coefficients equivalent to these linear predictive coefficients, and an exciting source signal producing means including an exciting pulse generator outputting a pulse train or a noise signal on the basis of the said exciting source information and wave forming means receiving said pulse train from said exciting pulse generator and delivering a wave-formed signal as an exciting source signal to be supplied to said loss-added synthesizing filter, said wave forming means having an impulse response prepared by inverting on a time basis an impulse response of a digital filter whose transfer function is the quotient obtained by dividing a transfer function of said synthesizing filter by another transfer function of said loss-added synthesizing filter.

* * * * *